United States Patent [19]

Lamer et al.

[11] Patent Number: 4,705,180

[45] Date of Patent: Nov. 10, 1987

[54] SUSPENDED LOAD POSITIONING STABILIZING SYSTEM

[75] Inventors: Gerald P. Lamer; Norbert W. Lenius; Richard A. Stearn, all of Sturgeon Bay, Wis.

[73] Assignee: Marine Travelift, Inc., Sturgeon Bay, Wis.

[21] Appl. No.: 702,835

[22] Filed: Feb. 19, 1985

[51] Int. Cl.[4] ..... B66C 23/52; B66C 11/12

[52] U.S. Cl. ..... 212/190; 212/146; 212/166; 212/205; 212/221; 294/81.4

[58] Field of Search ..... 212/146–148, 212/166, 190, 205–221; 294/81.4

[56] References Cited

U.S. PATENT DOCUMENTS

| | | | |
|---|---|---|---|
| 3,081,884 | 3/1963 | Minty | 212/126 X |
| 4,168,857 | 9/1979 | Kloos | 294/81.4 |
| 4,350,254 | 9/1982 | Noly | 294/81.4 |

FOREIGN PATENT DOCUMENTS

| | | | |
|---|---|---|---|
| 961894 | 1/1975 | Canada | 294/81.4 |
| 68749 | 9/1969 | German Democratic Rep. | 212/125 |
| 1186738 | 4/1970 | United Kingdom | 294/81.3 |
| 530842 | 12/1976 | U.S.S.R. | 212/147 |

*Primary Examiner*—Joseph F. Peters, Jr.
*Assistant Examiner*—R. B. Johnson
*Attorney, Agent, or Firm*—August E. Roehrig, Jr.

[57] ABSTRACT

A wire rope or cable stabilizing system for applying a balancing force to a suspended load to maintain vertical movement of the load perpendicular to the surface upon which the load is to be placed. The balancing force is effected to balance the lateral loading forces which may be applied to the suspended load such as may be due to, for example, the list or trim of a vessel, or the wind loading forces encountered when removing or replacing a hatch cover during a loading or unloading operation of a ship.

3 Claims, 8 Drawing Figures

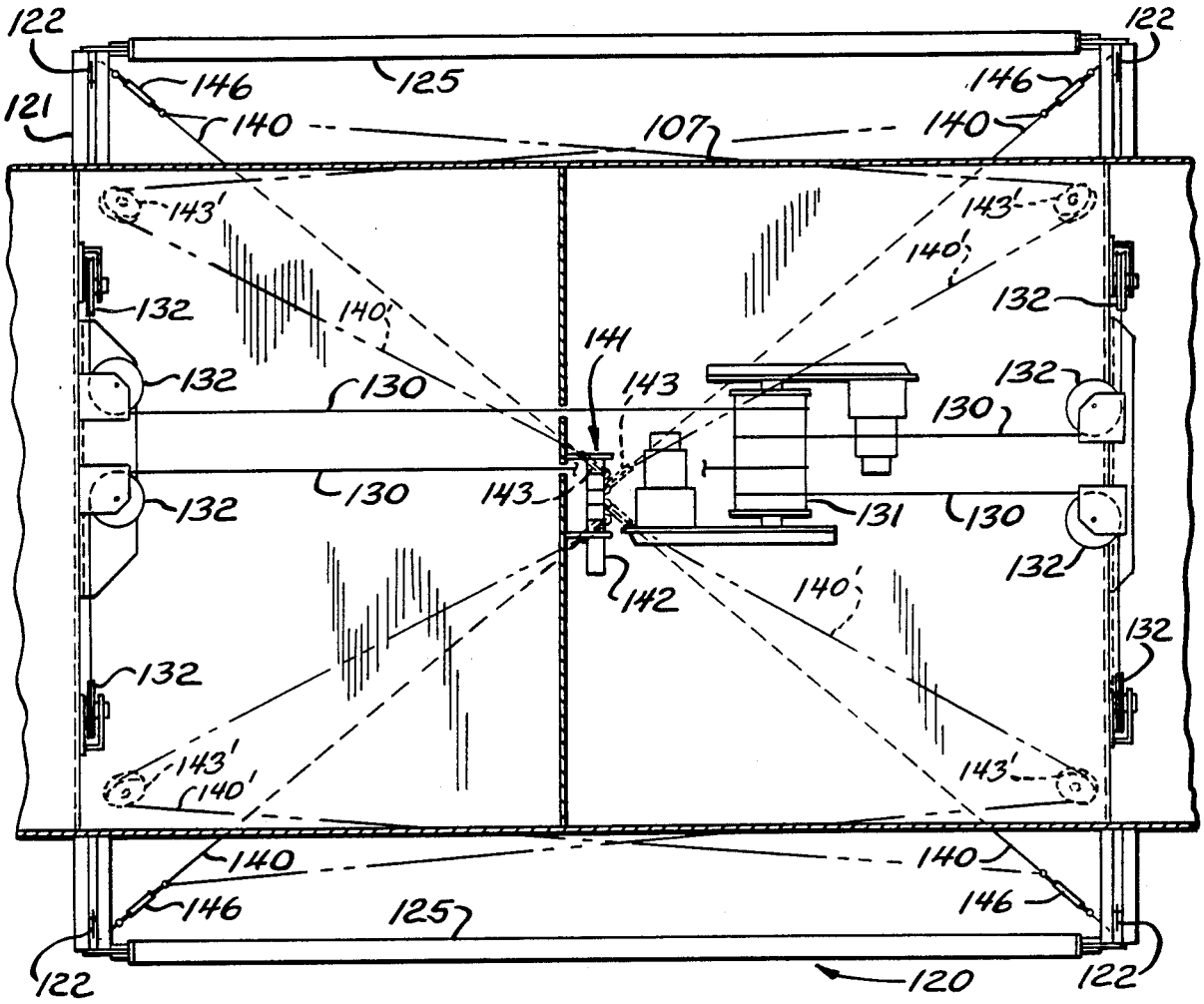
FIG. 5
FIG. 6
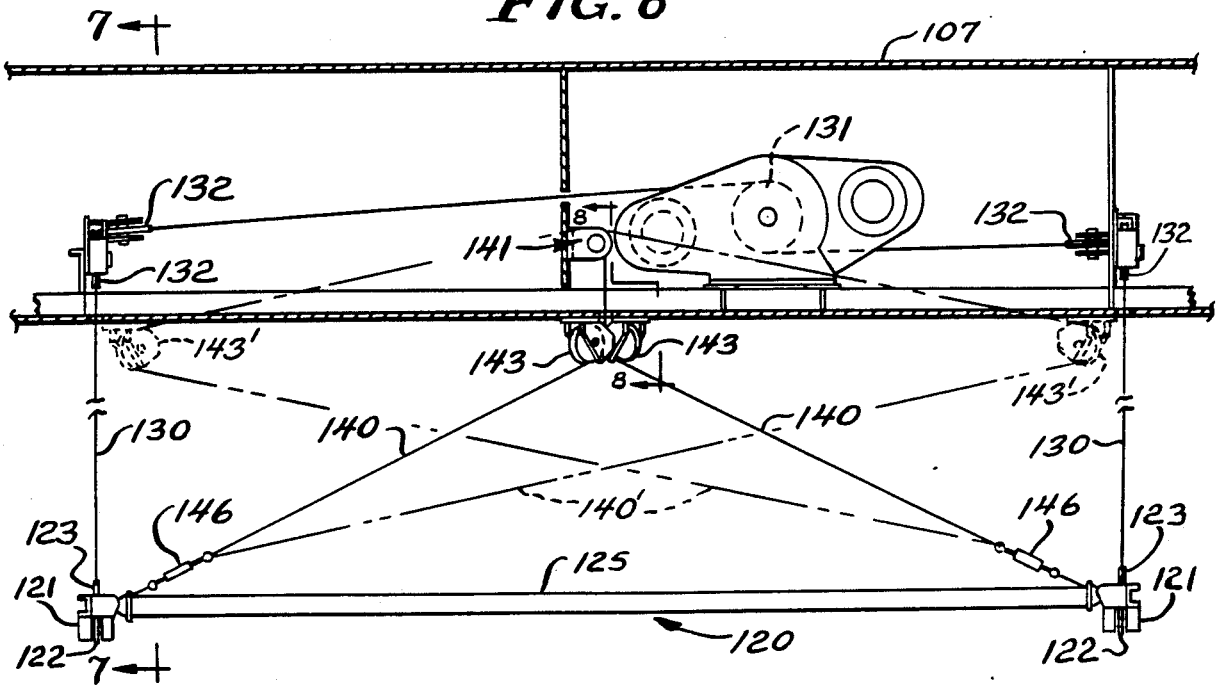

FIG. 7
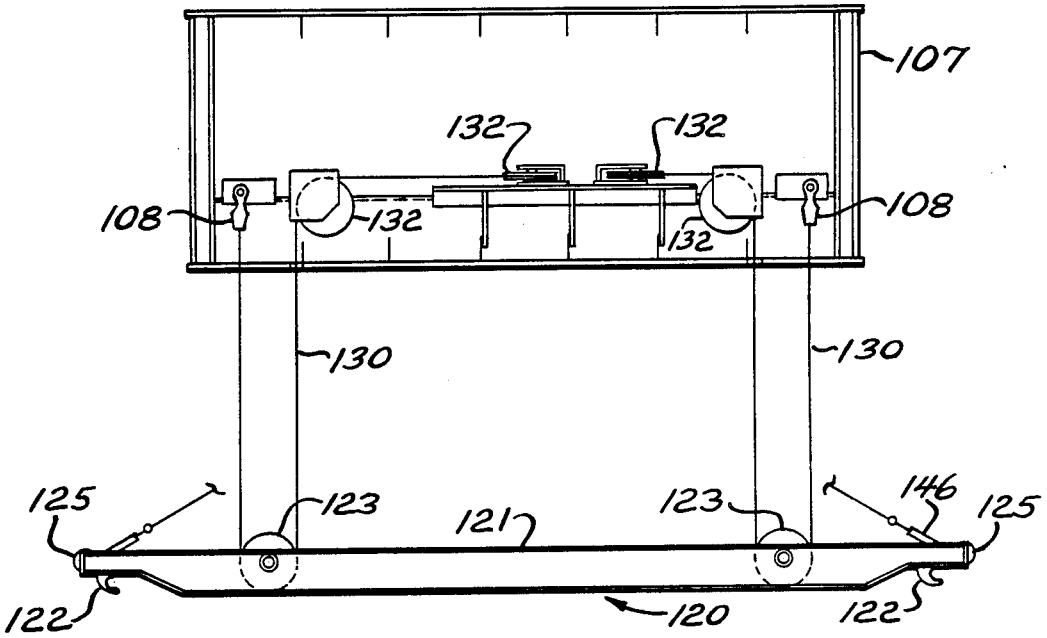
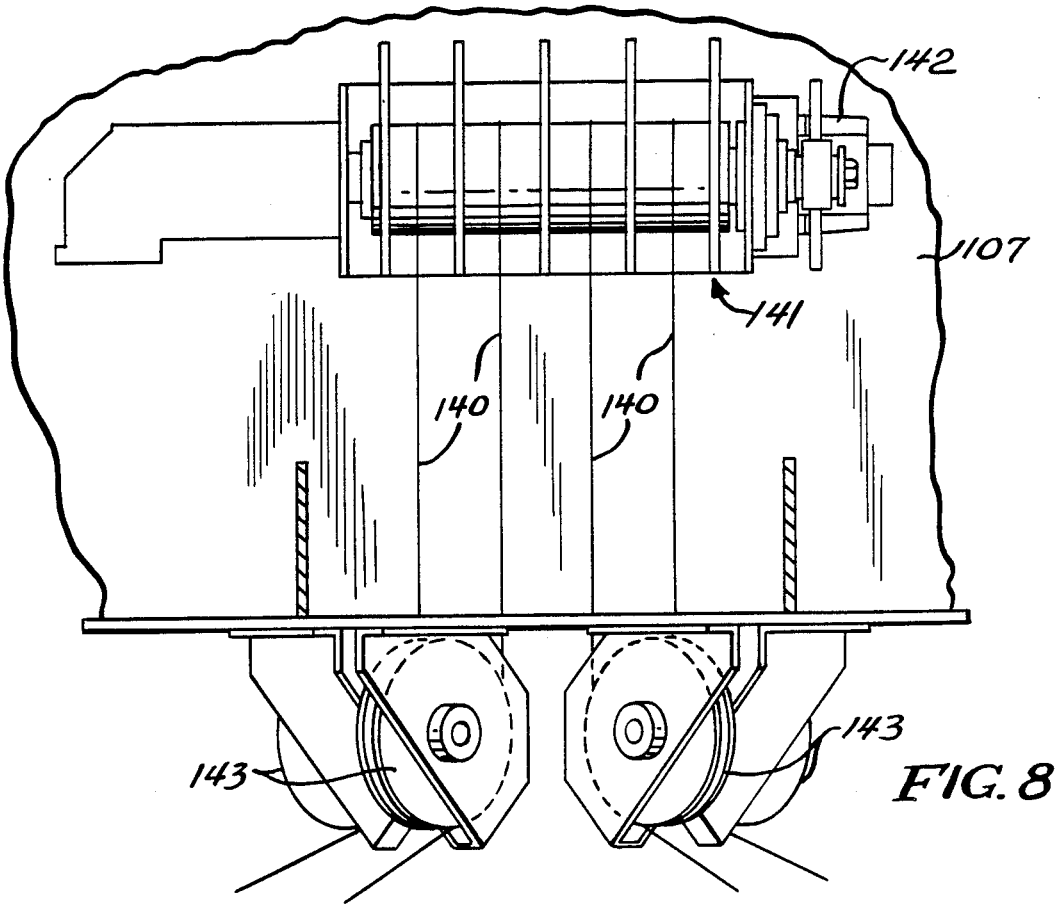
FIG. 8

SUSPENDED LOAD POSITIONING STABILIZING SYSTEM

BACKGROUND OF THE INVENTION

This invention relates in general to load positioning systems and, in particular, to a stabilizing system for maintaining the position of a suspended load in alignment with the plane upon which the load is to be placed. While the invention may be used for any application wherein it is desired or necessary to maintain vertical movement of a suspended load perpendicular to the surface upon which the load is to be placed, for convenience of illustration a preferred embodiment will be described with reference to its use with a hatch cover crane for positioning a hatch cover on a hatch coaming or cargo hold opening.

In seagoing vessels such as cargo-carrying ships, spaced openings are provided along the top of the deck, referred to as cargo hold openings or hatches. Various types of cargo, or bulk materials, are conveyed through these hatches into the ship's hold for transporting overseas. In order to protect the cargo contained within the ship's hold from the weather and elements encountered during a voyage, and to insure the ship's seaworthiness during heavy weather, these cargo hold openings are provided with a close-fitted covering, which is commonly referred to as a hatch cover. These hatch covers are made of a strong, heavy and durable metal adapted to fit closely about and cover the hatch coaming—a raised frame portion which extends upwardly around the hatch way to prevent water from running across the ship's deck into the ship's hold.

The use of heavy metal for the hatch cover results in the hatch cover being extremely bulky and heavy in order to withstand high wind forces, and the force of water which may pass over the ship's deck during heavy weather. In order to remove these hatch covers on some ships, a hatch cover crane is carried on the ship's deck. The hatch cover crane is movable along the length of the deck into a position directly over each of the hatch covers to remove and replace the hatch cover from the coamings.

In operation, the hatch cover crane is usually supported upon a pair of parallel tracks or rails which are positioned with one rail on each side of the hatches permitting the crane to straddle the hatch covers. The hatch cover crane is movable into a position directly over a hatch cover, and by proper positioning of the crane along these rails, hooks or other suitable engaging devices are aligned for attachment to the hatch cover. The crane lifting mechanism is then actuated to raise and remove the cover from the coaming, providing access to the ship's hold, or to lower the raised cover for closing the hatch.

During loading and unloading of the ship's hold, as is known, the ship may list to either side or fore and aft. Also, when attempting to replace the hatch cover on the coamings, a wind force may be encountered such that the raised cover shifts or oscillates making it difficult or impossible to maintain the hatch cover parallel to the ship's coamings. Since the fit between the hatch cover and the hatch coamings is necessarily generally with somewhat close tolerances, the position of the hatch cover and the hatch coaming has to be aligned in a parallel relationship to facilitate removal and replacement of the hatch cover. While movement of the crane along the pair of rails can compensate for some misalignment when replacing the hatch cover, such as due to fore and aft list, provision must be made to compensate for list to either side and lateral wind loading.

The hatch cover crane and hatch cover stabilizing system, to be described in detail hereinafter, provides a mechanism for removing the hatch cover from a hatch opening, and for replacing the removed cover on the opening whether or not the ship is listed to either side, fore or aft, or encounters a lateral wind load on the hatch cover. In addition, the stabilizing system provides a damping system for controlling oscillatory motion, such as occurs when the crane accelerates or decelerates while carrying a suspended cover.

The hatch cover crane includes a pair of hoist spreaders each carrying a hook for engaging the hatch covers. The hoist spreaders are positioned in spaced parallel relationship by a pair of struts and are raised and lowered through a plurality of hoist cables. A stabilizer cable system is secured to the hoist spreaders, and functions to provide a countering force to the lateral loading applied to the suspended hatch cover whether due to the ship listing to either side or wind loading, and dampens oscillatory movement. In this manner, the lateral force applied to the hatch cover will be balanced by the stabilizing system, and the cover may be raised and lowered perpendicular to the plane of the ship's deck. The hatch cover suspended from the hatch crane will thereby be in proper registry with the hatch coamings, regardless of the angles of list or trim of the vessel, or the wind forces encountered during a loading or unloading operation.

SUMMARY OF THE INVENTION

It is, therefore, an object of this invention to improve hatch cover cranes.

Another object of this invention is to balance the lateral loading forces encountered by a hatch cover crane due to the listing of the vessel, or the wind forces encountered during the loading or unloading operation.

A further object of this invention is to stabilize the lateral movement of a suspended hatch cover in order to maintain the hatch cover parallel to the plane of the vessel deck for proper registry of the hatch cover with the hatch coamings.

Yet another object of this invention is to insure that the vertical movement of a suspended load occurs perpendicular to the plane of the surface upon which the load is to be placed.

These and other objects are attained in accordance with the present invention wherein there is provided a wire rope or cable stabilizing system for applying a balancing force to a suspended load for maintaining vertical movement of the load perpendicular to the plane of the surface upon which the load is to be placed. The balancing force is effected to balance lateral loading forces applied to a suspended load such as those encountered on a ship's hatch cover due to the list or trim of the vessel, or the wind loading forces encountered during a loading or unloading operation of the ship.

DESCRIPTION OF THE DRAWINGS

Further objects of the invention, together with additional features contributing thereto and advantages accruing therefrom will be apparent from the following description of a preferred embodiment of the invention which is illustrated in the accompanying drawings, with like reference numerals indicating corresponding parts throughout, wherein:

FIG. 5 is a horizontal elevational view of a portion of the hatch cover crane and stabilizing system to better illustrate the cable arrangement for raising and lowering the hatch cover and stabilizing the hatch cover when suspended;

FIG. 6 is a front elevational view of the apparatus shown in FIG. 5 with a portion of a top support beam removed;

FIG. 7 is a cross-sectional view of the apparatus illustrated in FIG. 6 taken along lines 7—7; and FIG. 8 is an enlarged partial sectional view of a portion of the apparatus shown in FIG. 6 to better illustrate the fairleading of the stabilizer cables and their arrangement.

DESCRIPTION OF A PREFERRED EMBODIMENT

Figure 2:
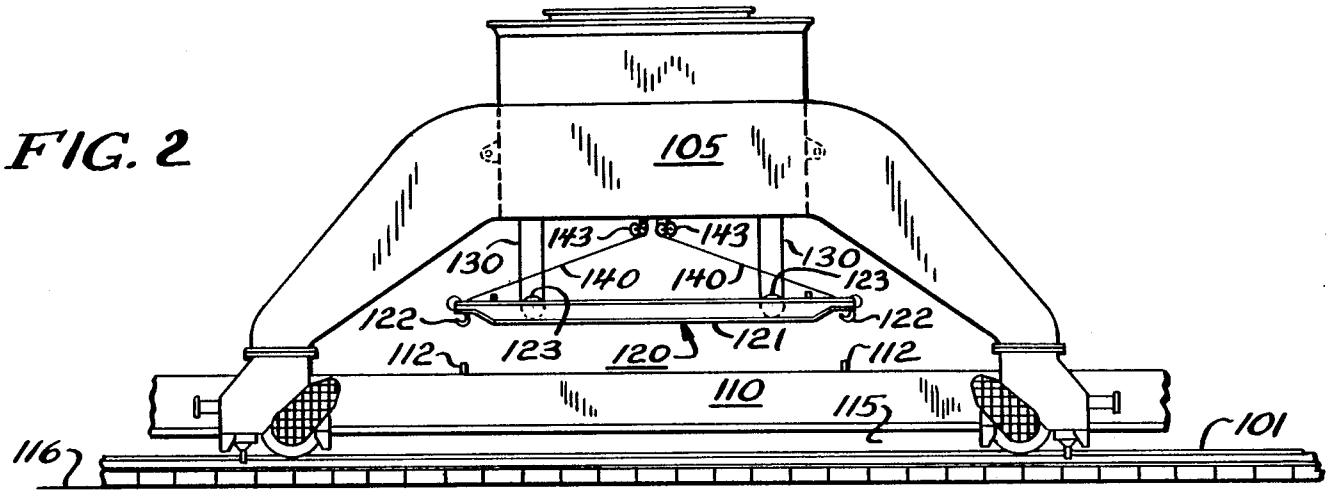
FIG. 2 is a side elevational view of one end of the hatch cover crane shown in FIG. 1.
Figure 1:
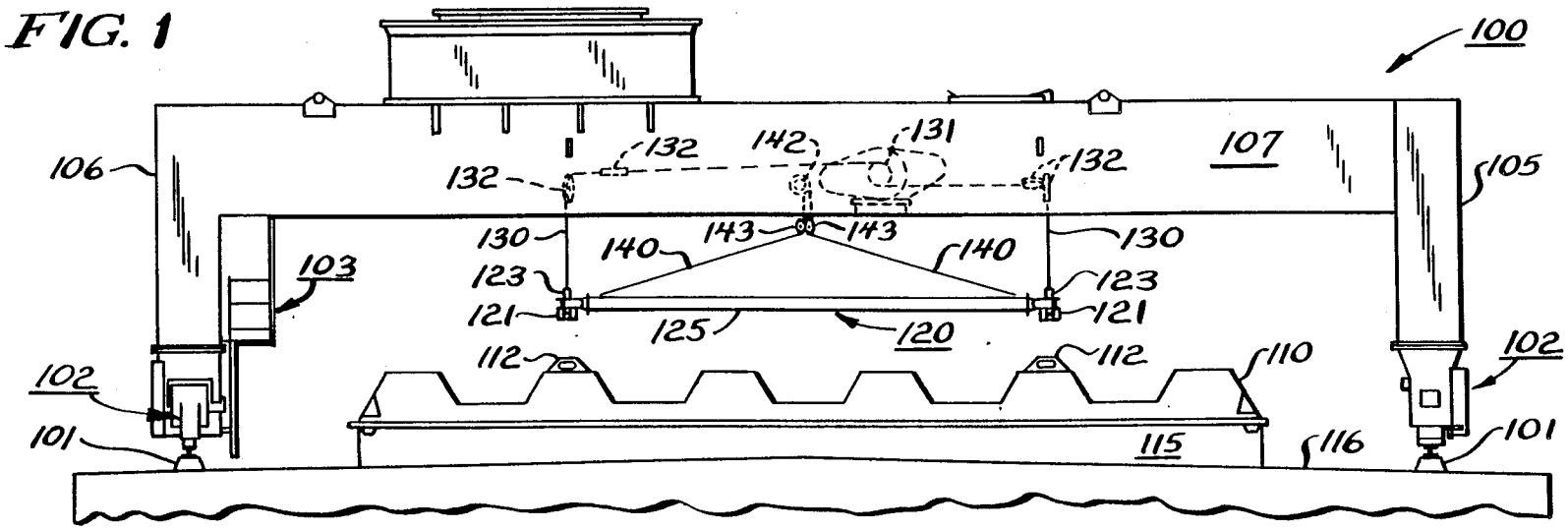
FIG. 1 is a front elevational view of a hatch cover crane supported on a vessel for removing and replacing a hatch cover on the hatch coamings.
Figure 4:
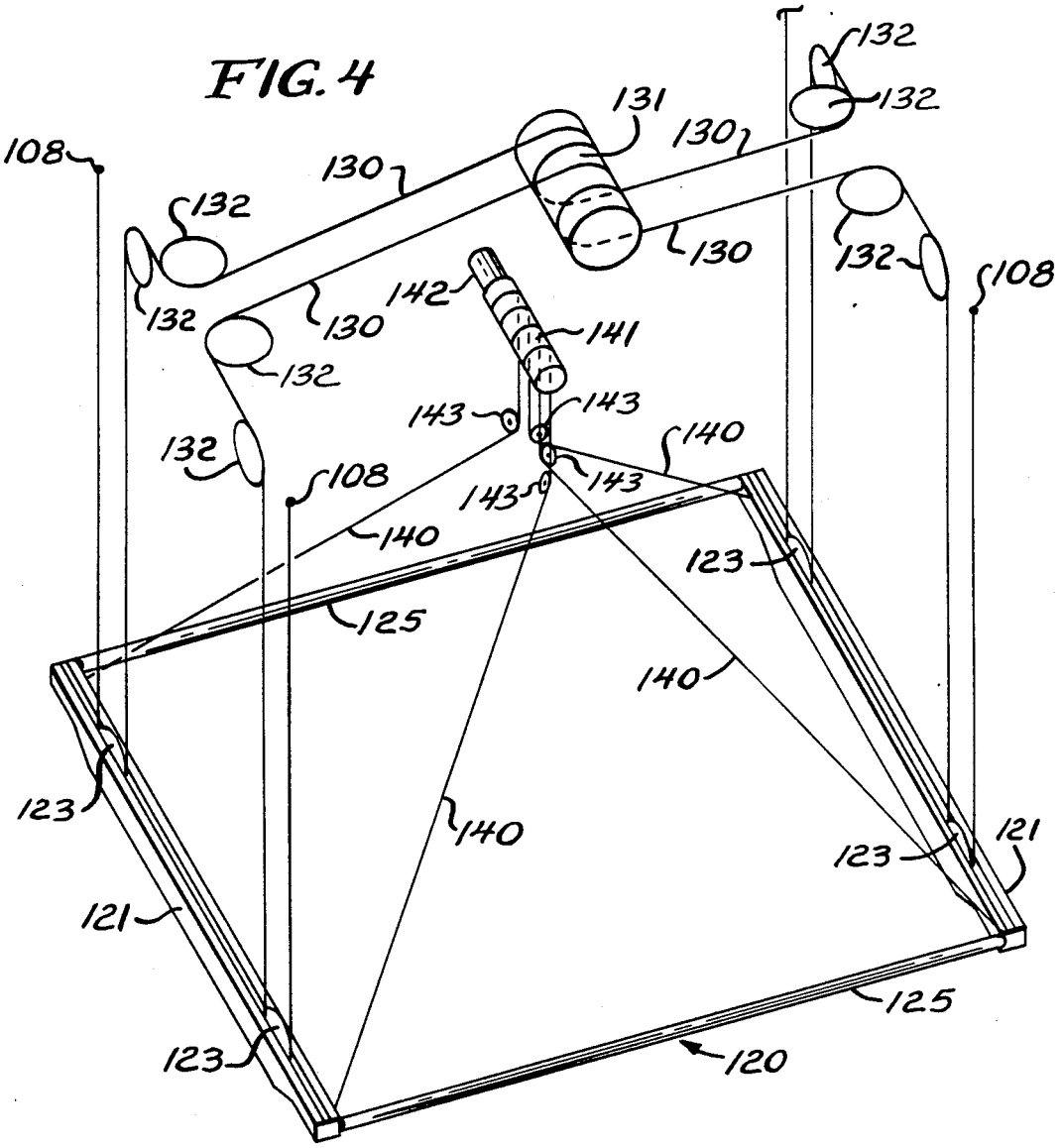
FIG. 4 is a mechanical schematic diagram of the cable mechanism employed with the hatch cover crane, to raise the hatch cover and to stabilize the hatch cover when suspended by the lifting mechanism.
Figure 3:
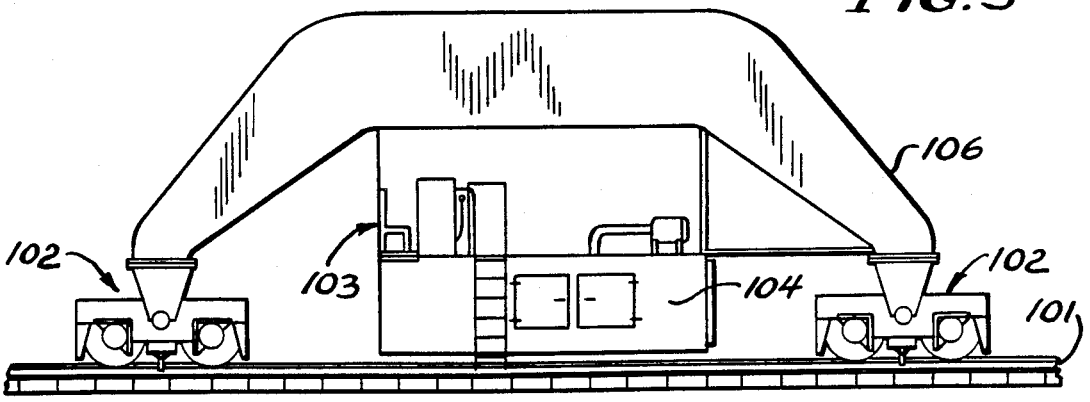
FIG. 3 is a side elevational view of the other end of the hatch cover crane shown in FIG. 1.

Referring now to the drawings, there is shown a hatch cover crane 100 having a hatch cover stabilizing system which maintains proper alignment between a hatch cover 110 and a hatch coaming, or cargo hold opening 115, in a ship. Although only one hatch over 110 and hatch coaming 115 are illustrated in the drawings, ships generally have a number of such cargo hold openings positioned along a deck 116, each of which is closed by a hatch cover.

To enable the hatch cover crane 100 to be positioned in alignment with each of these hatch covers 110, a pair of parallel rails 101 are secured to the deck 116 of the ship. The rails 101 extend longitudinally therealong forming a track upon which the hatch cover crane 100 is supported for movement along the length of the ship's deck 116 into a position enabling the hatch cover crane 100 to remove and replace any of the hatch covers on the cargo hold openings. The hatch cover crane 100 extends across the ship's deck a width greater than the width of the hatch covers 110, and is supported on the rails 101 by wheel assemblies 102 which ride upon the rails 101. A crane operator, positioned at a control station 103, controls operation of a motor 104 which operates to move the crane 100 along the tracks 101 into a position to raise and/or lower a hatch cover.

Raising and lowering of the hatch cover 110 is effected through a hoisting assembly whereby the hatch covers 110 are moved vertically in relation to the hatch coaming 115, and maintained in proper alignment therewith in a manner to be hereinafter described in detail. The hatch cover crane 100 includes two laterally spaced and similar end frames 105 and 106 which are each interconnected at an upper portion by a transversely extending upper support beam 107. The end frames 105 and 106 are substantially shaped as an inverted U, with the terminal portions of the legs of each supporting the wheel assemblies 102 rotatably journaled in each end to allow the hatch cover crane 100 to move along the support tracks 101.

A hoisting frame 120 is also supported from the top support beam 107 of the hatch cover crane 100, and includes a pair of parallelly spaced hoist spreaders 121 which extend parallel to the rails 101, and a pair of parallelly spaced struts 125 the ends of each being secured to the hoist spreaders 121 and which extend transversely between each end of the hoist spreaders to form the rectangularly shaped hoisting frame 120. Each hoist spreader 121 has a hook 122 supported adjacent each end thereof for engagement with hook eyes 112 of the hatch cover 110, or any other such suitable hook engaging structure. The hooks 122 are carried by each hoist spreader 122 such that the hoist frame 120, upon being lowered over the hatch cover 110 with the hooks 122 adjacent to the hook receiving structure 112 of the hatch cover, may be driven forward to facilitate drivein engagement. In that manner, when the hatch cover crane 100 is moved forwardly, the hook receiving structure 112 of the hatch cover 110 will be engaged by the hooks 122 of the hoist spreaders 121 in a proper position for lifting the hatch cover 110 from the hatch coaming 115.

Raising and lowering of the hoist frame 120 is effected by means of a hoist cable system wherein each one of four hoist cables 130 are separately secured by one end to a hoist cable drum 131 supported within the upper support beam 107. The hoist cables 130 pass from the hoist cable drum 131 such that a pair of hoist cables 130 extend toward each of the hoist spreaders 121, and each one of the pair of hoist cables passes about a pair of hoist cable lead sheaves 132 and extends downwardly toward a hatch crane hoist beam sheave 123. Each hoist beam sheave 123 is rotatably supported within the hoist spreader 121, and the hoist cable 130 passes thereabout to return in an upward direction with each hoist cable being dead-ended 108 on the upper support beam 107. Preferably, the cable drum 131 is located at the center of the hatch crane upper support beam 107. The cable drum 131 is driven such that upon rotation, hoist frame 120 will be raised or lowered depending upon the direction of rotation of the hoist cable drum 131.

When the hoist cable drum 131 is rotated, if the hatch crane 100 is level, as, for example, when the ship is not listed either way, and if there is no significant lateral wind loading, the hatch cover 110 can be raised or lowered in a horizontal plane without requiring load compensation. However, if the ship is listed, or when wind forces are present, the hatch cover 110 must be stabilized in order to facilitate removal of the cover from the hatch coaming 115, or the replacement thereon.

To this end, a stabilizing system is provided wherein four equal length stabilizer cables 140 are each secured by one end to a stabilizer cable drum 141 driven by a torque motor 142 and also supported within the upper support beam 107. Each one of the stabilizer cables 140 extends from the stabilizer cable drum 141 about a stabilizer cable lead sheave 143. Each of the stabilizer lead sheaves 143 is angled or may be pivoted, for fairlead to the end of one of the hoist spreaders 121. In this manner, the stabilizer cable 140 passing about the stabilizer cable lead sheave 143 will be directed towards an end of one of the hoist spreaders 121, whereat the cable is secured by means of a turnbuckle connection 146 as best shown in FIGS. 5–7.

As also shown in FIGS. 5 and 6, there is illustrated in phantom an alternative stabilizing cable arrangement. In this embodiment, the stabilizing cable lead sheaves 143' are positioned removed from the stabilizer cable drum 141 adjacent the hoist cable lead sheaves 132. In this embodiment, the stabilizer cables 140' are longer in length than cables 140, and extend across the hatch cover 110 in a crossing pattern to be connected to a turnbuckle 146 on the opposite side from the side at which the stabilizer lead sheave 143' is supported. In this manner, the angle at which the stabilizer cables 140' are attached to the turnbuckles 146 is decreased enhancing the stabilizing system.

In operation, since the hatch cover crane 100 does not have a traversing mechanism, the hatch cover 110 must be raised and lowered perpendicular to the plane of the deck and of the upper support or top beam 107 of the hatch crane so that the cover 110 will properly register with the hatch coaming 115 regardless of the angle of list or trim of the vessel. The torque motor 142 is actuated hydraulically from a pressure side of the hoist mechanism obtaining high torque when a hatch cover 110 is being hoisted or lowered, and low torque when there is no lead on the hoist spreaders 121. When the hatch crane 100 is level, the stabilizing cables 140 are of equal length and have equal horizontal force components. Therefore, the hatch cover 110 will be raised in a horizontal plane without tipping to either side, or to fore or aft.

However, when the hatch crane 100 is tipped, for example, due to the listing of the ship, or when a wind load is applied to the hatch cover 110, an unequal horizontal force will be applied to the stabilizing cable system. If, for example, the ship lists to the left, a horizontal force will be applied to the lefthand stabilizer cables equal to the load (weight of the hatch cover) times the tangent of the angle of list plus the residual horizontal force in the right-hand stabilizer cables. This will increase the force on the left-hand cables. Likewise, the load on the right-hand stabilizing cables will decrease. If the list is great enough, the total torque of the torque motor 142 will be applied to the stabilizing cables leading to the left spreader 121.

Since the amount of lateral movement of the hatch cover 110 is a function of the total length of the cable from the stabilizer cable drum 141 to each of the spreaders 121, and the diameters of the wires, the actuation of the torque motor 142 applied to the stabilizing cables 140 associated with the left hoist spreader 121 will counterbalance the increased loading on that side. This counterbalancing of the unequal load tending to cause the lateral movement of the hatch cover 110, will according maintain the hatch cover 110 in a position to be raised or lowered perpendicular to the plane of the deck and of the top beam 107 of the hatch crane 100 for proper registration with the hatch coaming 115. In this manner, the hatch cover 110 will be properly registered with the hatch coaming 115 regardless of the angle of list or trim of the vessel, or the applied wind load.

While the invention has been described in the specification and illustrated in the drawings with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment illustrated by the drawings and described in the specification as the best manner presently contemplated for carrying out this invention, but that the invention will include any embodiments falling within the scope of the appended claims.

We claim:

1. A hatch cover crane for removing and/or replacing a hatch cover carried upon a hatch coaming to close a ship's cargo hold opening comprising a movable support frame having an upper support member extending a width greater than the width of a hatch cover which is to be moved by the hatch cover crane, a hoisting frame suspended from said movable support frame by a plurality of hoisting cables said hoisting frame comprising a pair of hoisting spreaders positioned in spaced parallel relation by a pair of parallelly spaced struts, each one of said struts being connected at its opposite ends to one of said hoisting spreaders for forming a substantially rectangularlyshaped hoisting frame and including hook means for engaging a hatch cover to be moved, hoisting means carried by said movable support frame and coupled to said hoisting frame for effecting vertical movement thereof for raising and lowering the hatch cover relative to the hatch coaming, said hoisting means including a plurality of hoisting cables operatively connected to said hoisting spreaders for raising and lowering the hoisting frame formed thereby, and stabilizing means carried by said movable support frame and coupled to said hoisting frame for applying a stabilizing force to said hoisting frame to equalize uneven loading forces applied thereto during operation of said hoisting means and to maintain the vertical movement of the hatch cover perpendicular to the hatch coaming.

2. A hatch cover crane for removing and/or replacing a hatch cover carried upon a hatch coaming to close a ship's cargo hold opening comprising a movable support frame having an upper support member extending a width greater than the width of a hatch cover which is to be moved by the hatch cover crane, a hoisting frame suspended from said movable support frame by a plurality of hoisting cables and including hook means for engaging a hatch cover to be moved, hoisting means carried by said movable support frame and coupled to said hoisting frame for effecting vertical movement thereof for raising and lowering the hatch cover relative to the hatch coaming, and stabilizing means carried by said movable support frame and coupled to said hoisting frame for applying a stabilizing force to said hoisting frame to equalize uneven loading forces applied thereto during operation of said hoisting means and to maintain the vertical movement of the hatch cover perpendicular to the hatch coaming, said stabilizing means including at least four stabilizer cables, each one of said stabilizer cables being operatively connected at one end to a stabilizer cable drum and at another end mutually exclusively to one end of one of said hoisting spreaders, said stabilizer cable drum being operatively connected to a torque motor, and said torque motor being operable to apply a countering force through at least one of said stabilizer cables to balance any unequal application of a loading force applied to the hatch cover crane during operation of said hoisting means.

3. A hatch cover crane for removing and/or replacing a hatch cover carried upon a hatch coaming to close a ship's cargo hold opening comprising a movable support frame having a top support beam carried at each end by an end frame which includes wheel assemblies for facilitating movement of the support frame upon a ship's deck, a hoisting frame including a pair of hoisting spreaders positioned in spaced parallel relation by a pair of parallelly spaced struts, each one of said struts being connected at opposite ends to an end of one of said hoisting spreaders to form a substantially rectangularly-shaped hoisting frame, a hoisting drum carried by said top support beam and rotatably driven for raising or lowering said hoisting frame, each one of said hoisting spreaders including a hook carried at each end thereof for engaging a hatch cover to be moved and further including a hatch crane hoist beam sheave rotatably supported at each end for receiving a hoist cable for raising or lowering said hoisting frame, four hoisting cables, each one of said hoisting cables being connected at one end to said hoisting drum and extending outwardly therefrom in pairs toward one of said hoisting spreaders, each one of said pair of hoisting cables mutually exclusively passing about one of said hatch crane hoist beam sheaves and passing upwardly therefrom with the end thereof being dead-ended on said top support beam such that upon rotation of said hoisting drum said hoisting cables effect vertical movement of said hoisting frame, a stabilizer cable drum carried by said top support beam and rotatably driven by a torque motor operatively connected to said hoisting drum to effect the operation of said stabilizer cable drum in response to unequal forces applied to said hoisting cables, four stabilizer cables, each one of said stabilizer cables being connected at one end to said stabilizer cable drum and mutually exclusive extending outwardly therefrom toward one end of one of said hoisting spreaders, and each one of said stabilizer cables passing about a stabilizer cable lead sheave for facilitating fairlead to an end of said hoisting spreaders and being connected at said hoisting spreader end for applying a pulling force thereto in response to rotation of said stabilizer cable drum to equalize uneven loading forces applied to said hoisting frame.

* * * * *